US006193362B1

(12) United States Patent
Nakata et al.

(10) Patent No.: US 6,193,362 B1
(45) **Date of Patent: *Feb. 27, 2001**

(54) CONNECTION UNIT FOR AN INKJET HEAD, AND AN INKJET CARTRIDGE AND INKJET PRINTER USING THE SAME

(75) Inventors: Toshio Nakata, Matsumoto; Atsushi Nishioka, Shiojiri; Yukihiro Hanaoka, Narakawa-mura; Kazuhiko Sato, Hata-machi; Tsutomu Yamazaki, Suwa, all of (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/267,427

(22) Filed: Mar. 12, 1999

Related U.S. Application Data

(63) Continuation-in-part of application No. 09/234,728, filed on Jan. 21, 1999, now Pat. No. 6,074,036, which is a continuation of application No. 08/700,900, filed on Aug. 21, 1996, now Pat. No. 5,874,971.

(30) Foreign Application Priority Data

| | | |
|---|---|---|
| Aug. 22, 1995 | (JP) | 7-213838 |
| Jul. 11, 1996 | (JP) | 8-182517 |
| Mar. 16, 1998 | (JP) | 10-064876 |

(51) Int. Cl.[7] ..... B41J 2/175
(52) U.S. Cl. ..... 347/86
(58) Field of Search ..... 347/85, 86, 87, 347/20, 54, 65, 68, 56

(56) References Cited

U.S. PATENT DOCUMENTS

| | | | |
|---|---|---|---|
| 4,500,895 | 2/1985 | Buck et al. | 347/86 |
| 5,477,247 | 12/1995 | Kanegae | 347/20 |
| 5,581,288 | 12/1996 | Shimizu et al. | 347/87 |
| 5,874,971 * | 2/1999 | Nishioka et al. | 347/20 |

FOREIGN PATENT DOCUMENTS

| | | |
|---|---|---|
| 0 419 193 | 3/1991 | (EP) . |
| 0 565 334 | 10/1993 | (EP) . |
| 585 615 A2 | 3/1994 | (EP) . |
| 585 615 A3 | 3/1994 | (EP) . |
| 0 709 201 | 5/1996 | (EP) . |
| 55-109668 | 9/1980 | (JP) . |
| 60-183157 | 9/1985 | (JP) . |
| 62-82051 | 4/1987 | (JP) . |
| 62-124955 | 6/1987 | (JP) . |
| 4-107043 | 9/1992 | (JP) . |
| 6-210869 | 8/1994 | (JP) . |
| 7-195704 | 8/1995 | (JP) . |
| 9-57997 | 3/1997 | (JP) . |
| 94 16897 | 8/1994 | (WO) . |

* cited by examiner

*Primary Examiner*—N. Le
*Assistant Examiner*—Anh T. N. Vo

(57) ABSTRACT

A connection unit for an inkjet head whereby an ink supply passage is formed by bonding an inkjet head component to a case member such that ink ejection problems do not occur, ink does not leak, reliability is high, and manufacturing is simple. A bonding channel 218*e* encircling an ink supply opening 218*h* is provided between the bonding surfaces of the head component 210 and head case 218. Adhesive is then injected from an adhesive injection opening 218*d* to fill the bonding channel to an vent hole 218*f*.

16 Claims, 13 Drawing Sheets

CONNECTION UNIT FOR AN INKJET HEAD, AND AN INKJET CARTRIDGE AND INKJET PRINTER USING THE SAME

CONTINUING APPLICATION DATA

This application is a continuation-in-part of U.S. patent application Ser. No. 09/234,728, filed Jan. 21, 1999, now U.S. Pat. No. 6,074,036, which is a continuation of application Ser. No. 08/700,900, filed Aug. 21, 1996, now U.S. Pat. No. 5,874,971, the contents of each of which are incorporated herein by reference.

BACKGROUND OF THE INVENTION

1. Field of the Invention

The present invention relates to an inkjet printer for recording on a recording medium by ejecting ink from an inkjet head, and more specifically relates to a connection unit for connecting an inkjet head with a reservoir, whereby ink is supplied to the inkjet head.

2. Description of the Related Art

One method of connecting an ink supply passage to an inkjet head is to bond the inkjet head to a part of the supply passage with adhesive to form the ink supply passage through which ink is supplied to the inkjet head. For example, in Japanese Unexamined Patent Application Publication (kokai) H9-57997 (1997-57997), the present inventors have previously disclosed a method for bonding an inkjet head to a case member having an ink supply opening. This method uses a recessed member to form a space, which is later filled with adhesive, between the inkjet head and case member, and provides an opening to this space. Adhesive is then injected through the opening to fill the space purposely formed between the head component and case member, and thus assemble the head component and case member.

This method simultaneously fixes the head to the case, and seals the ink supply passage connection. It is thus an extremely effective means of improving the efficiency of assembling units with an inkjet head. However, it also leaves for improvement the following problems.

First, it is necessary to strictly control the amount of injected adhesive so that the space is filled with the right amount. This is to prevent the adhesive from overflowing into the ink passage as a result of injecting too much adhesive, and to prevent any gap from forming at the bonding surface between the head component and case member as a result of injecting not enough adhesive.

Second, it is necessary to use a relatively high adhesive injection pressure in order to sufficiently fill the space purposely formed between the head component and case member with adhesive.

OBJECTS OF THE INVENTION

Therefore, it is an object of the present invention to overcome the aforementioned problems.

It is another object of the present invention to provide a connection unit for an inkjet head whereby managing the amount of the adhesive fill is simplified, adhesive injection is possible at a relatively low pressure, and a high reliability connection unit free of ink ejection defects and ink leakage can be achieved.

SUMMARY OF THE INVENTION

A connection unit for an inkjet head according to the present invention comprises a first component, a second component, and adhesive for fixing the first component to the second component. The first component has a first passage, a first surface in which is formed a first opening in communication with the first passage, and a second surface provided surrounding the first surface. The second component has a second passage, a third surface in which is formed a second opening in communication with the second passage, and a fourth surface provided surrounding the third surface. The first component is positioned to the second component so that the first surface abuts the third surface, the first opening is aligned with the second opening, and a space (gap) is formed between the second surface and fourth surface. A third opening for injecting adhesive to said space, and a fourth opening for bleeding air from inside said space, are further disposed to the first component or the second component.

When adhesive is injected from the third opening to the space, air in the space is expelled from the fourth opening. With the fourth opening thus functioning as an air vent hole, adhesive can be injected using relatively low pressure to fill the space with adhesive. Furthermore, even when adhesive is injected at relatively low pressure, seal defects will not occur in the connection as a result of air remaining in the space.

It is also easy to confirm when the space has been filled with an appropriate amount of adhesive because it is sufficient to simply keep injecting adhesive until the adhesive flows to the fourth opening. By using this as a guide to how much adhesive has been injected, it is also easy to control how much adhesive is filled to the space.

The space in a connection unit according to the present invention is preferably formed to have an annular shape such that the annulus is divided into two segments in communication with the third opening and fourth opening, and the fourth opening is positioned relative to the third opening so that the lengths of two segments are substantially equal.

In this case, adhesive injected from the third opening passes through two paths formed by the space, and reaches the fourth opening at substantially the same time. As a result, there is no chance of air remaining in the space.

It will also be obvious that a connection unit according to the present invention can be variously comprised without departing from the intended scope of the invention.

For example, in a further connection unit according to the present invention the first component has a first passage, and a first surface in which is formed a first opening in connection with the first passage. The second component has a second passage, a second surface in which is formed a second opening in connection with the second passage, and a third surface provided surrounding the second surface. In this case, the first component is positioned to the second component so that the first surface abuts the second surface, the first opening is aligned with the second opening, and a space(gap) is formed between the third surface and first surface.

Further alternatively, a positioning means is provided for positioning the first component in a specific position relative to the second component so that the first opening is aligned with the second opening.

The present invention further provides an inkjet cartridge having a reservoir connected to either the first or the second component of the connection unit.

Yet further, the present invention provides an inkjet printer comprising an inkjet head having a reservoir in connection with the second component of the connection unit, and an inkjet head having one or more nozzles in connection with the first passage of said connection unit.

Other objects and attainments together with a fuller understanding of the invention will become apparent and appreciated by referring to the following description and claims taken in conjunction with the accompanying drawings.

BRIEF DESCRIPTION OF THE DRAWINGS

In the drawings wherein like reference symbols refer to like parts.

DESCRIPTION OF THE PREFERRED EMBODIMENTS

The preferred embodiments of the present invention are described below with reference to the accompanying figures.

First Embodiment

A connection unit according to a first preferred embodiment of the present invention is described in detail below with reference to FIG. 1 to FIG. 6. It should be noted that this preferred embodiment is described below using an inkjet cartridge by way of example only, and the present invention shall not be limited to a cartridge type inkjet head. Specifically, it will be obvious that the present invention can be adapted to any type of connection unit used for supplying ink to an inkjet head.

Figure 1:
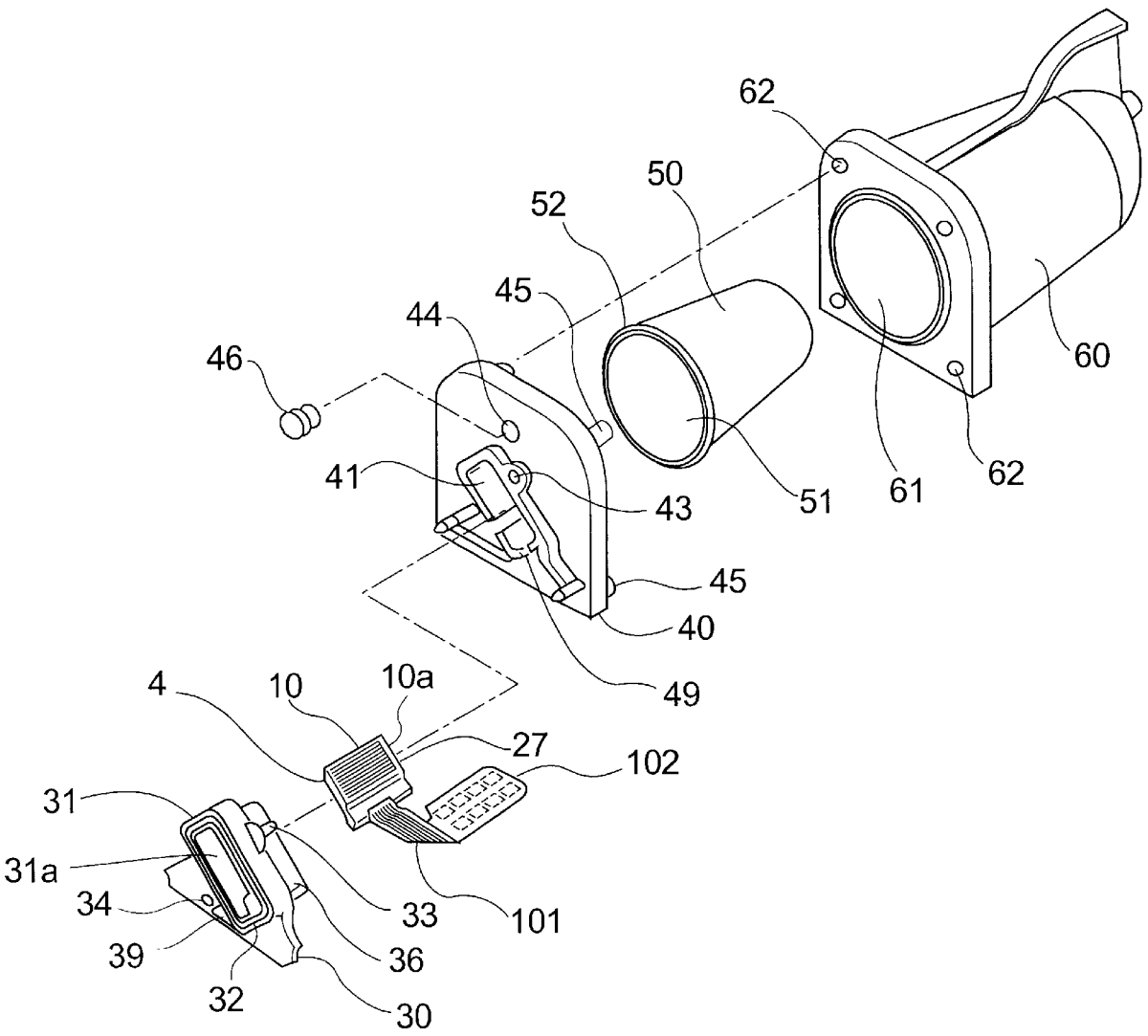
FIG. 1 is a partially exploded perspective view of an inkjet cartridge containing a connection unit according to the present invention.
Figure 2:
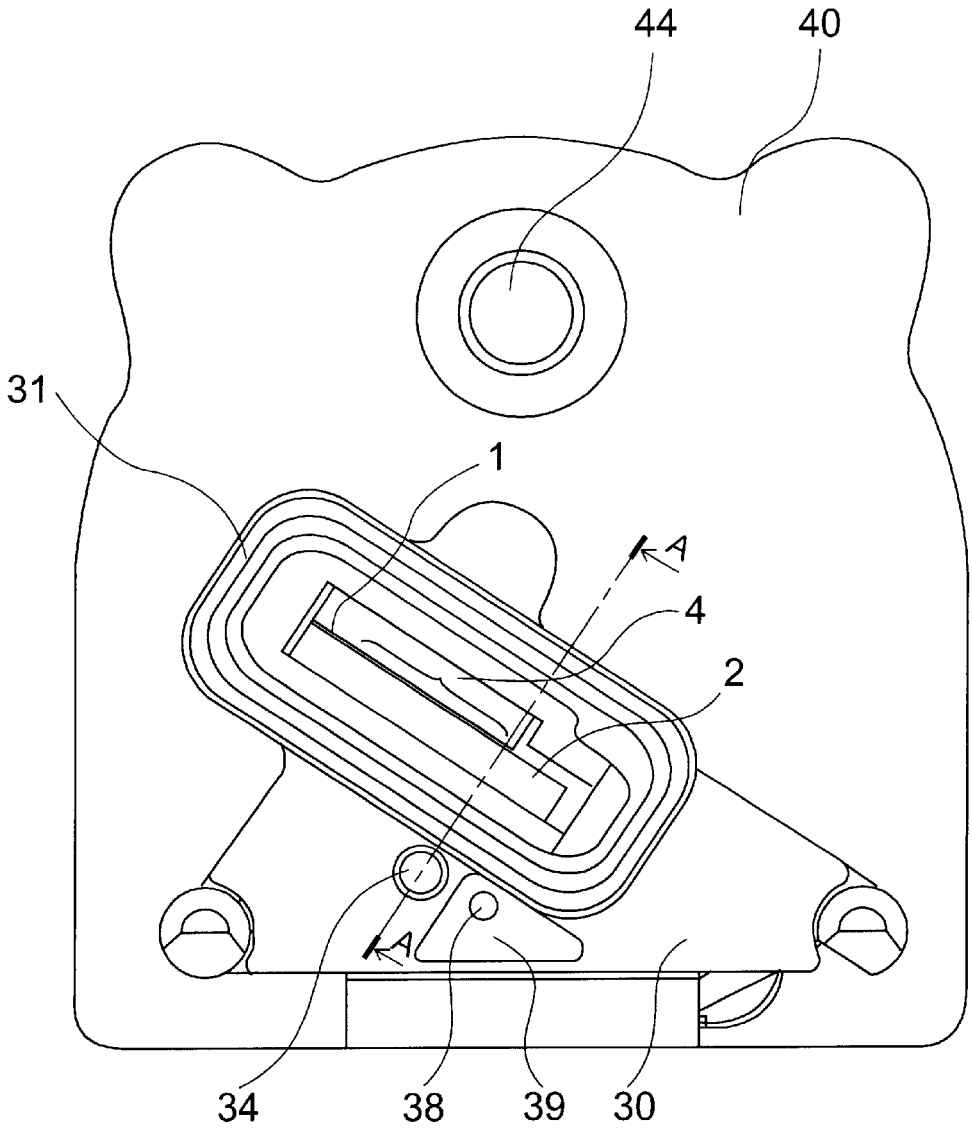
FIG. 2 is a front view of the inkjet cartridge shown in FIG. 1.
Figure 3:
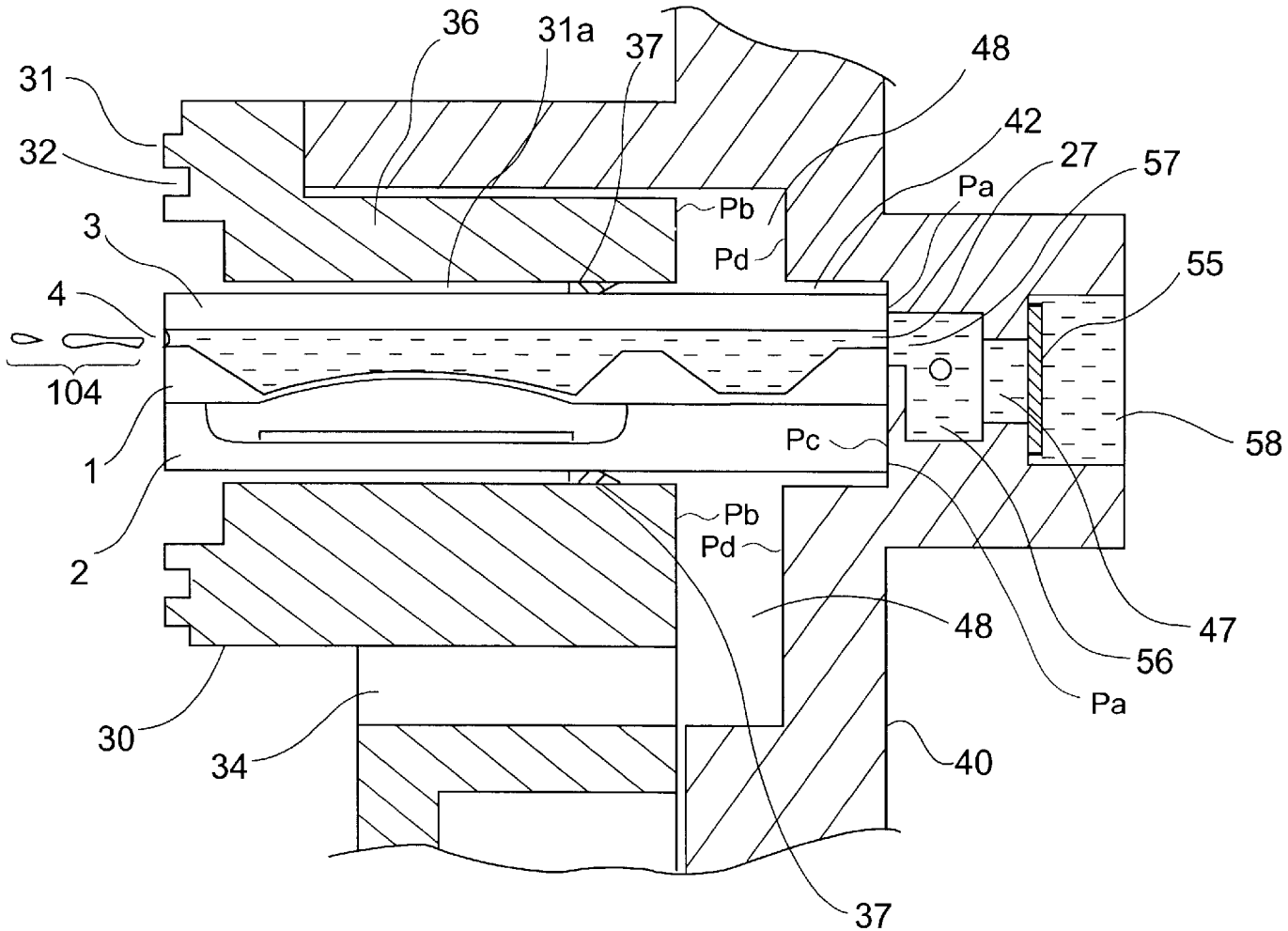
FIG. 3 is a partial cross-sectional view through line A—A in FIG. 2 of the inkjet cartridge shown in FIG. 2.
Figure 4:
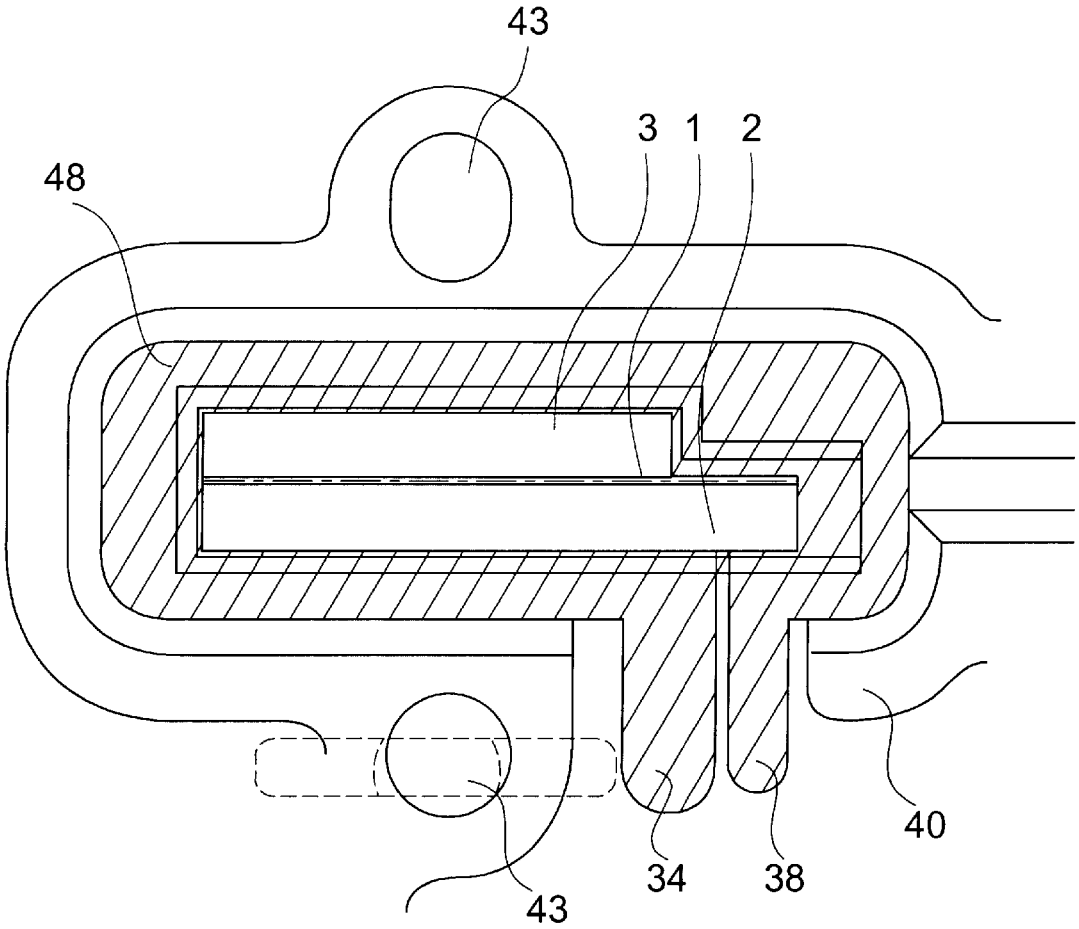
FIG. 4 shows the bonding channel 48 when filled with an adhesive in the inkjet cartridge shown in FIG. 1.

FIG. 1 is a partially exploded perspective view of an inkjet cartridge containing a connection unit according to the present invention. FIG. 2 is a front view of the same inkjet cartridge from the nozzle face side thereof. FIG. 3 is a cross-sectional view taken through line A—A in FIG. 2 of the connection unit part of the same inkjet cartridge. FIG. 4 shows the bonding channel 48 when filled with adhesive.

As shown in FIG. 1, an inkjet cartridge according to this preferred embodiment comprises a connection unit and ink supply unit. The connection unit comprises a head case 40, nozzle case 30, and head component 10. The ink supply unit comprises an ink sack 50, and ink case 60.

Note, further, that while a connection unit according to this preferred embodiment comprises a first component comprising a head component 10 and nozzle case 30, and a second component comprising a head case 40, these first and second components can each be formed as a single integrated part, or can be assembled from a plurality of parts, as will become obvious from the following description.

Figure 5:
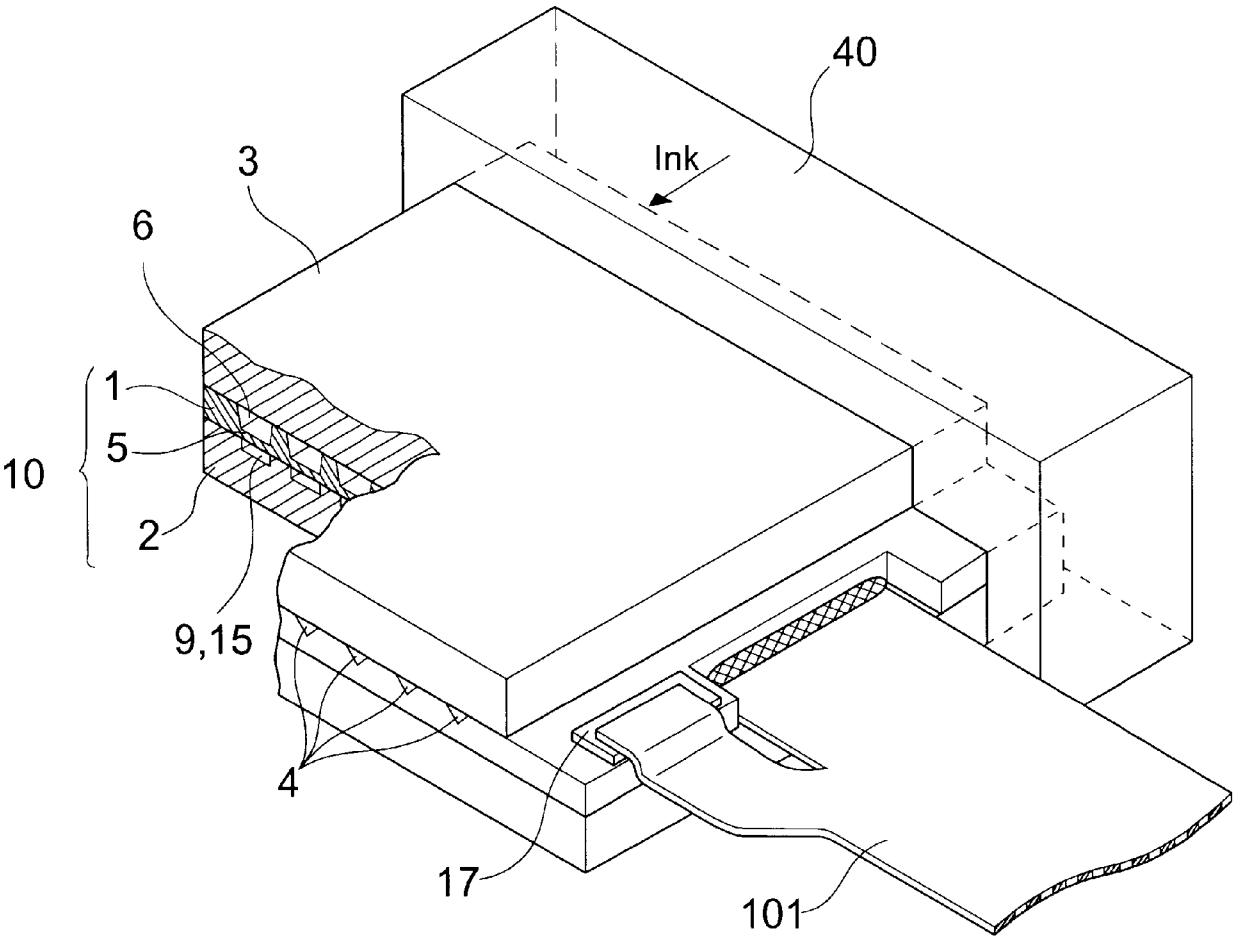
FIG. 5 is an a perspective view of a head component according to a first embodiment of the present invention.
Figure 6:
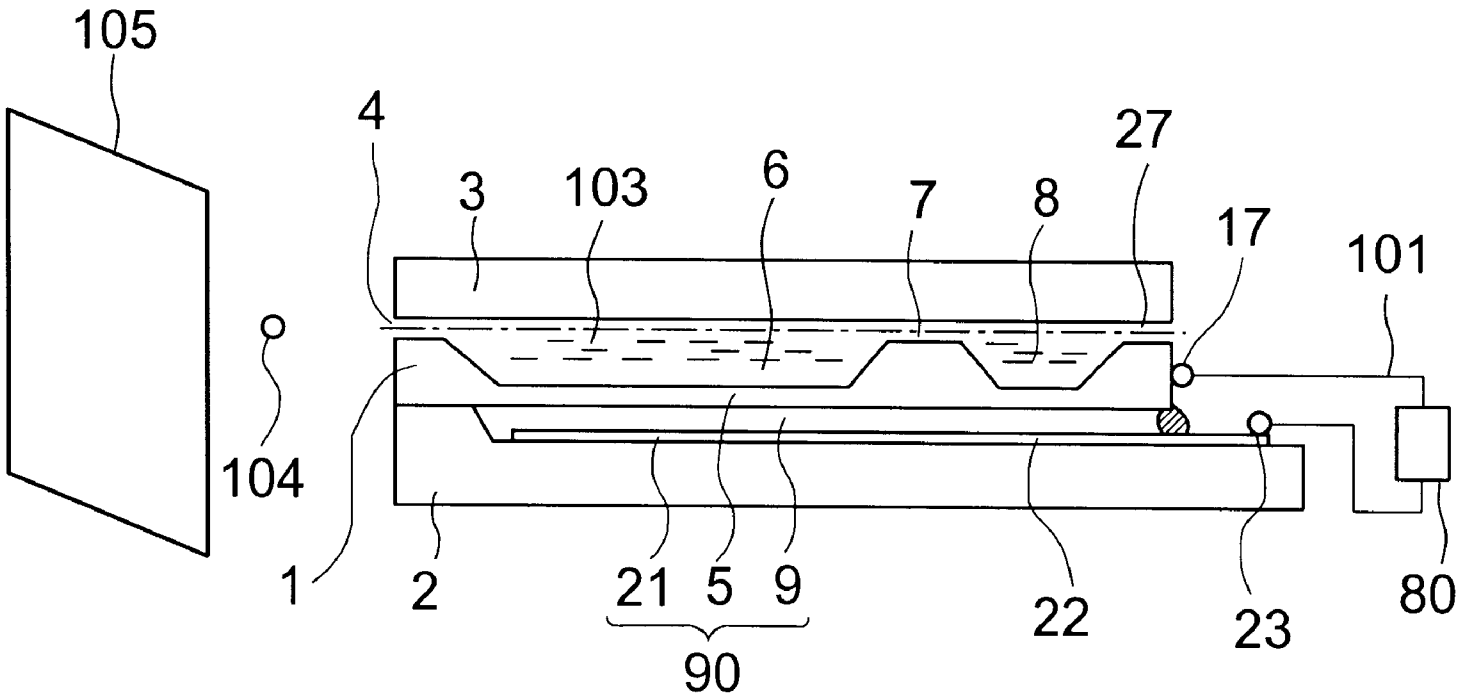
FIG. 6 is a cross-sectional view of the head component shown in FIG. 5.

FIGS. 5 and 6 show an exemplary head component 10 used in the present invention. FIG. 5 is a perspective view of a head component connected by a connection unit according to the present embodiment to an ink supply means. FIG. 6 is a section view of the head component shown in FIG. 5.

A head component 10 has a laminated structure of three bonded substrates 1, 2, and 3, each comprised as described in detail below.

Substrate 1 is a silicon substrate in the top surface of which, as seen in FIG. 5, a plurality of recesses is formed. When substrate 3 is bonded to this top surface, these recesses form a plurality of nozzles 4, each having an associated ejection chamber 6 and orifice 7 at the back of the ejection chamber 6, a common ink cavity 8, and an ink lead-in opening 27 at the back of the common ink cavity 8. A bottom wall of each ejection chamber 6, which is an ejection pressure generating means, is a diaphragm 5. The common ink cavity 8 is the ink supply source from which ink is supplied to each of the ejection chambers 6.

Substrate 2 bonded to the bottom surface of substrate 1 is typically borosilicate glass, and has formed in the surface thereof bonded to the bottom of substrate 1 a plurality of recesses 15. These recesses 15 form vibration chambers 9 for disposing an electrode below the corresponding diaphragm 5 of substrate 1. An ITO conductive film is sputtered onto the bottom of recess 15 such that when substrate 2 is bonded to substrate 1, an individual electrode 21 is formed corresponding to each of the diaphragms 5 in substrate 1 thereabove. Each individual electrode 21 is connected to a lead 22 and terminal 23.

The substrate 3 bonded to the top surface of substrate 1 is also typically of borosilicate glass. Nozzles 4, ejection chambers 6, orifices 7, common ink cavity 8, and ink lead-in opening 27 are formed by bonding substrate 3 to substrate 1.

The head component 10 is assembled with head case 40, nozzle case 30, ink sack 50, and ink case 60 to form an inkjet cartridge, which can then be installed in a printer.

A flexible printed circuit (FPC) 101 for sending signals to an electrostatic actuator 90 is inserted to groove 49 of head case 40, and a terminal area 102 of the FPC 101 is fixed to a bottom surface of the ink case 60. The electrostatic actuator 90 in this embodiment comprises vibration chambers 9, diaphragms 5, and individual electrodes 21 arrayed in rows inside the head component 10.

When the inkjet cartridge is installed to a printer carriage (not shown in the figures), terminals in the carriage connect electrically with the terminal area 102 of the FPC, and common electrode 17 and individual electrodes 21 are connected via FPC 101 to a drive circuit 80 in the printer. The electrostatic actuator 90 is then charged by drive circuit 80, and the resulting electrostatic force causes diaphragm 5 to deflect toward individual electrode 21. The pressure inside ejection chamber 6 thus drops, pulling ink 130 from the common ink cavity 8 into ejection chamber 6. When charging then stops and the charge accumulated in electrostatic actuator 90 is rapidly discharged, the inherent resilience of the diaphragm 5 returns the diaphragm 5 to its original shape. This causes a rapid rise in the internal pressure of ejection chamber 6, ejects an ink drop 104 from 4, and thus prints to recording paper 105.

As will be known from the above, a first ink passage is formed inside head component 10, which is part of the above-noted first component, by common ink cavity 8, orifice 7, and the ejection chamber 6 open to nozzle 4. Nozzles 4 are formed to one end surface of head component 10, and at the other end Pa (first surface) are formed ink lead-in openings 27 (first opening).

Nozzle case 30, which with head component 10 forms the above-noted first component, is molded from acrylonitrile-styrene (AS) resin, ABS resin, polysulfone, or other resin material. Nozzle plate 31 is equipped with nozzle case 30, and has in the middle thereof an opening 31*a* in which the nozzles 4 are exposed when the head component 10 is assembled therein. An ink-stop groove 32 is provided around the opening 31*a*.

When ink ejection problems develop as a result of a clogged nozzle 4 or a bubble trapped inside the ink passage, a recovery operation is performed in which, typically, external pressure is applied to the ink sack 50 to expel the bubble or viscous ink (an operation known as priming). The ink-stop groove 32 functions to trap and hold therein ink expelled from the nozzle(s) by means of the surface tension of the ink. A user initiates priming by observing the amount of expelled ink. That is, the area inside this groove is preset so that an appropriate level of priming occurs when ink is expelled to fill inside the groove.

A protruding wall 36 for forming a bonding channel (gap) further described below is formed on the back of nozzle case 30 around the outside of the opening. Two pins 33 for connecting the head case are further disposed to the back of the nozzle case 30. An adhesive injection opening 34 (third opening) is disposed at a bottom part of the nozzle case 30 front. This adhesive injection opening 34 connects to the bonding channel further described below.

The head case 40 part of the second component is molded from a transparent resin such as polysulfone, polycarbonate, or ABS resin, and has linkage holes 43 on the surface thereof opposite the nozzle case 30. The pins 33 of the nozzle case are press fit to these linkage holes 43 to connect the nozzle case 30 and head case 40.

A recess 41 in which the nozzle case protruding wall 36 is inserted is formed at approximately the middle of the head case 40 front. A recess 42 (shown in FIG. 3) in the same shape as nozzle case opening 31*a* is formed in the middle of this recess 41. The ink lead-in opening 27 side of head component 10 is housed inside this recess 42.

With the head component 10 thus housed in head case 40, nozzle case 30 is connected to the head case 40 so as to cap the head case 40. As shown in FIG. 3, a pair of claws 37 for holding the head component 10 therebetween is disposed inside the protruding wall 36 of the nozzle case 30. When the cases are coupled together, these claws 37 work to push the head component 10 against the bottom of recess 42 in head case 40.

Head component 10 is thus held inside the case with the ink lead-in opening 27 end Pa (first surface) of the head component 10 in contact with bottom Pc (third surface) of recess 42 in head case 40, and ink lead-in opening 27 (first opening) of head component 10 linked to ink supply opening 57 (second opening) of head case 40.

The claws 37 also function to position head component 10 to the case. In addition, bottom Pd (fourth surface) of recess 41 in head case 40 is also formed around bottom Pc (third surface) of recess 42, and a space is formed inside the case between bottom Pd (fourth surface) and end Pb (second surface) of nozzle case protruding wall 36. That is, a space band (bonding channel 48) is formed substantially surrounding the outside very near the ink lead-in opening 27 of head component 10.

Adhesive injection opening 34 (third opening) in connection with bonding channel 48, and an vent hole 38 (fourth opening), are further disposed to nozzle case 30. Adhesive is injected to bonding channel 48 from adhesive injection opening 34 using, for example, a dispenser having an injection needle. The injected adhesive gradually fills the bonding channel 48. Filling the bonding channel 48, shown as the shaded area in FIG. 4, ends when the adhesive reaches the vent hole 38. As the adhesive is injected, air inside the bonding channel 48 is bled from the vent hole 38.

Note that it does not matter if the adhesive overflows to the adhesive puddle 39 at this time.

Furthermore, while there are areas between the adhesive injection opening 34 and vent hole 38 where bonding channel 48 is not present, the adhesive permeates the gap between the nozzle case 30 and head case 40 by means of capillary action. The adhesive also permeates the gap between the head component 10 and head case 40 by means of capillary action. Adhesive thus seals around the ink lead-in opening 27 of head component 10, and fastens head component 10 to head case 40.

As described above, however, head component 10 is supported by claws 37 with the ink lead-in opening 27 linked to the ink supply opening 57, and end Pa (first surface) of head component 10 in contact with bottom Pc (third surface) of recess 42 in head case 40. While an inconsequential amount of adhesive thus penetrates to the gap between these surfaces, it will not enter the ink lead-in opening 27 or ink supply opening 57.

A complete passage from the ink supply unit to the nozzles is thus formed by a connection unit for an inkjet head comprised and bonded according to this preferred embodiment. That is, ink supplied from ink supply tubes 47 and 56 (second ink passage) formed in the back of head case 40 passes to the ink lead-in opening 27 of head component 10 without leaking and without ink flow being obstructed by adhesive, for example, that has penetrated into the ink passage. The ink can therefore be ejected as an ink drop 104 from nozzle 4 by appropriately driving the pressure generating means of the head.

It is furthermore possible with a connection unit thus comprised according to this preferred embodiment to fix the head component to the head case, and reliably connect the ink passage formed inside the individual members, by injecting adhesive from a single adhesive injection opening 34, and confirming that adhesive has been filled to an vent hole 38. In addition, it is not necessary to precisely adjust and control the amount of injected adhesive, and the adhesive can be easily injected at low pressure.

An ink filling port 44 is further disposed at the top of the head case 40 front, and is closed with a press-fit plug 46 except during ink injection. This plug 46 is made to prevent foreign matter from entering the ink filling port 44 when it is pressed into place, and is preferably made from nylon, for example, but can be alternatively made from polyimide or other soft resin. It can even be a metal ball.

A filter 55 (FIG. 3) is also heat fused to the opening of the ink supply tube 47 (FIG. 3) formed in the back of the head case. A plurality of pins 45 are also formed in the back of the head case for connecting to the ink case 60.

The ink sack 50 is preferably made from butyl rubber with a circular opening 51 formed at one end thereof as shown in FIG. 1. The edge of this opening 51 is an O-ring-like packing member 52. This packing member 52 is held and seals between head case 40 and ink case 60.

Pressure (negative pressure) must be constantly applied in the direction tending to return ink from the head component 10 to the ink passage inside the inkjet cartridge in order to prevent ink from leaking from the inkjet cartridge nozzles 4 during standby states when printing is not in progress, and when the inkjet cartridge is removed from the printer. Such negative pressure is achieved in this preferred embodiment by means of the natural elasticity (shape retention characteristics) of the ink sack 50.

Similarly to the head case 40, the ink case 60 is also made from a transparent resin such as polysulfone, polycarbonate, or ABS resin, and has an opening 61 on the side thereof opposite head case 40. The ink sack 50 is held inside this opening 61. A plurality of linkage holes 62 are also formed. The pins 45 of the head case are press fit to these linkage holes 62 to couple the head case 40 and ink case 60.

Second Embodiment

A connection unit according to a second preferred embodiment of the present invention is described next below with reference to FIG. 7 to FIG. 13. It should be noted that like parts in this embodiment and the first preferred embodiment shown in FIG. 1 to FIG. 6 are identified by like reference numbers, and further description thereof is thus omitted below.

Figure 7:
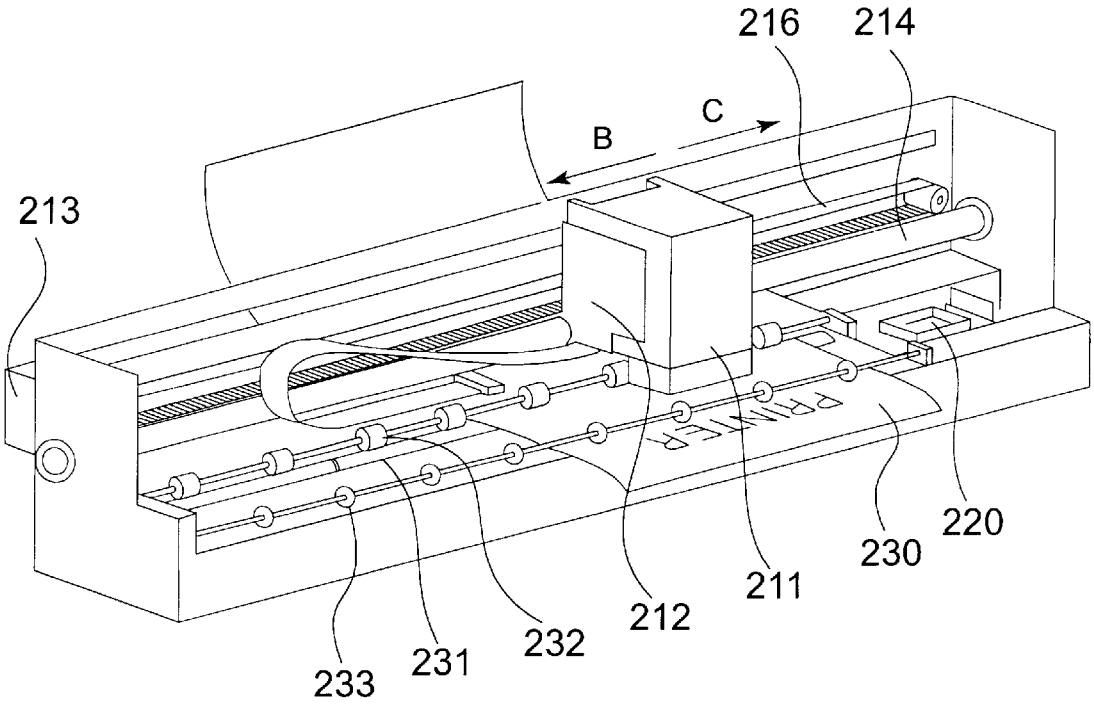
FIG. 7 is a perspective view of an inkjet printer to which a print head according to a second embodiment of the present invention is utilized.

FIG. 7 is a perspective view of an inkjet printer in which is installed a print head according to this second preferred embodiment. As shown in FIG. 7, the print head 211 is mounted on a carriage 212, which is guided along a guide shaft 214 as it is moved by means of carriage motor 213 and intervening belt 216 in the directions of arrows B and C. A cap 220 (see FIG. 8A) caps the nozzle 210*d* surface (see FIG. 8B) of the head component 210 bonded to the bottom part of print head 211. Printing paper 230 is transported by paper feed roller 231 and pressure roller 232, passes below the print head 211, and is ejected from the inkjet printer by paper ejection roller 233.

Figure 8B:
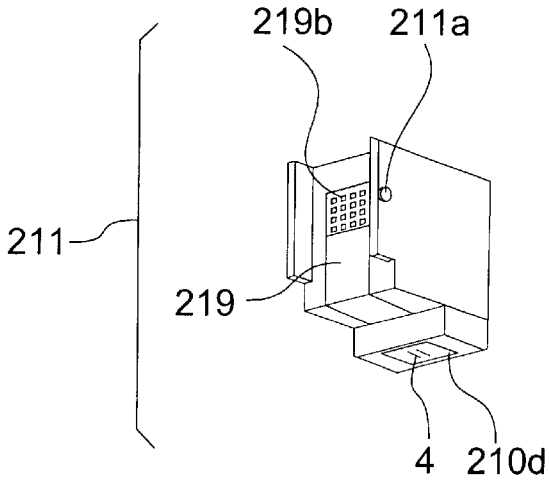
FIG. 8B is a perspective view of the removed print head of FIG. 8.
Figure 8A:
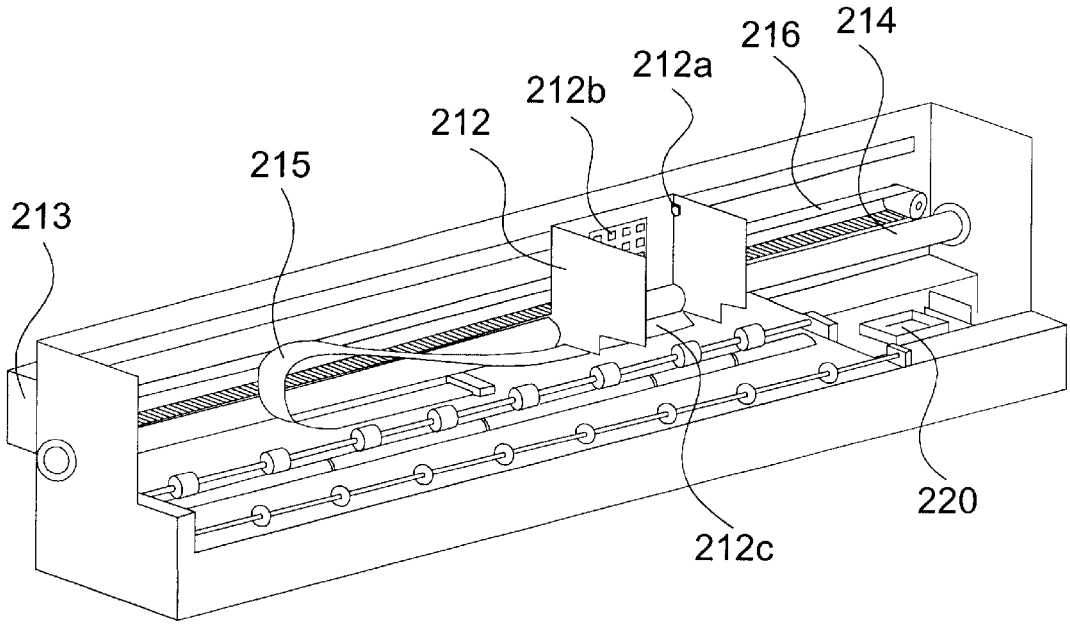
FIG. 8A is a perspective view of the inkjet printer shown in FIG. 7 when the print head has been removed.

FIGS. 8A and 8B are perspective views of the print head 211 removed from the inkjet printer. An ink tank is mounted in the print head 211 as a single unit. When the ink in the ink tank is depleted, the print head 211 removed together with the ink tank from the inkjet printer for replacement. When the print head 211 is mounted to the carriage 212, print head 211 is urged upward by means of a spring 212*c* disposed at the bottom of the carriage 212, pins 211*a* disposed on the right and left sides of print head 211 engage hooks 212*a*, and the print head 211 is thus secured to the carriage 212.

Electrical signals transmitted via flat cable 215 are relayed from terminals 212*b* on carriage 212, through terminals 219*b* on the head FPC 219, to the plural electrostatic actuators 90 (see FIG. 11) in head component 210 to selectively drive electrostatic actuators 90, thereby ejecting ink from the nozzle 4 corresponding to the driven electrostatic actuator 90 to print.

The construction and assembly of this print head 211 are described next below with reference to FIGS. 9 to 13.

Figure 9:
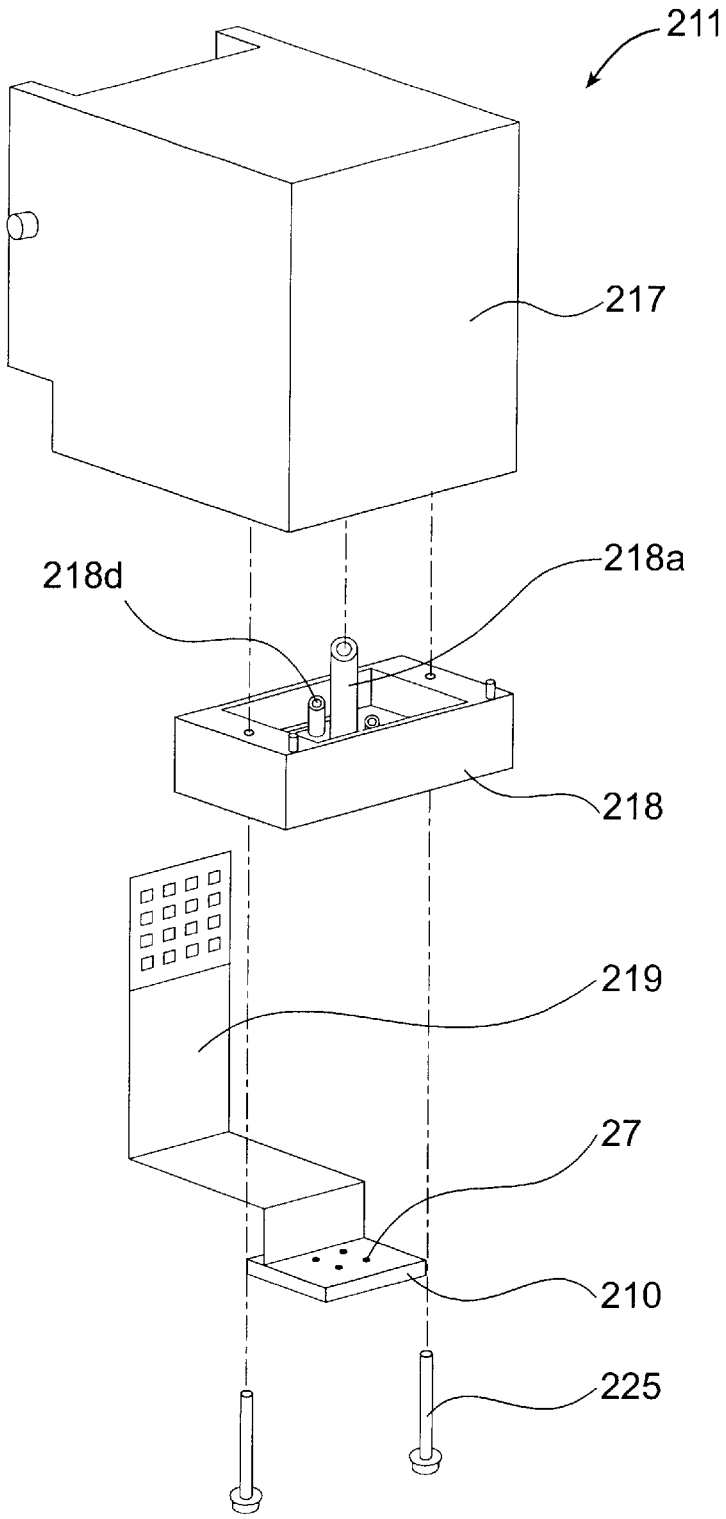
FIG. 9 is a partially exploded perspective view of a print head containing a connection unit according to a second embodiment of the present invention.
Figure 10:
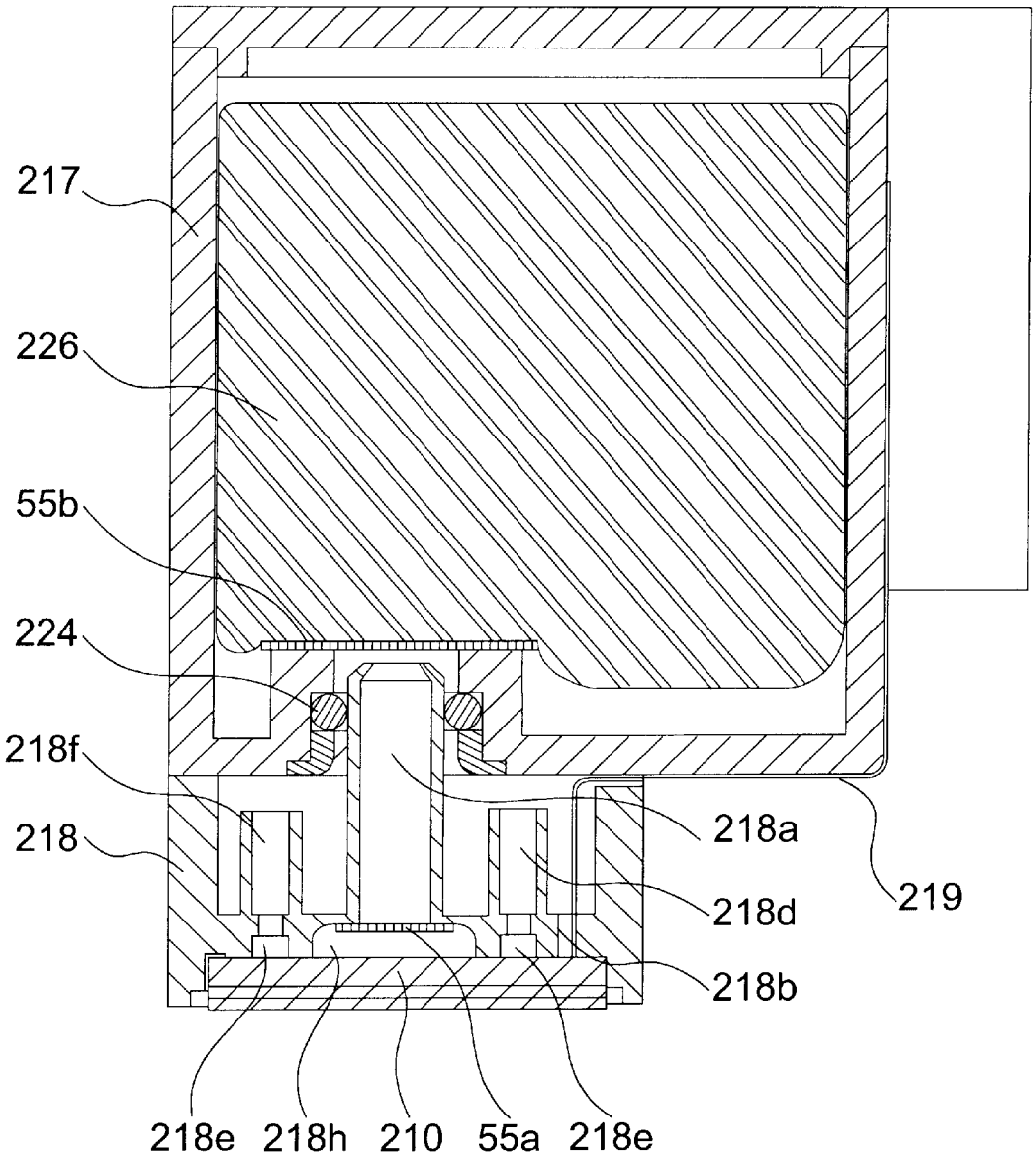
FIG. 10 is a cross-sectional view of the print head shown in FIG. 9.
Figure 11:
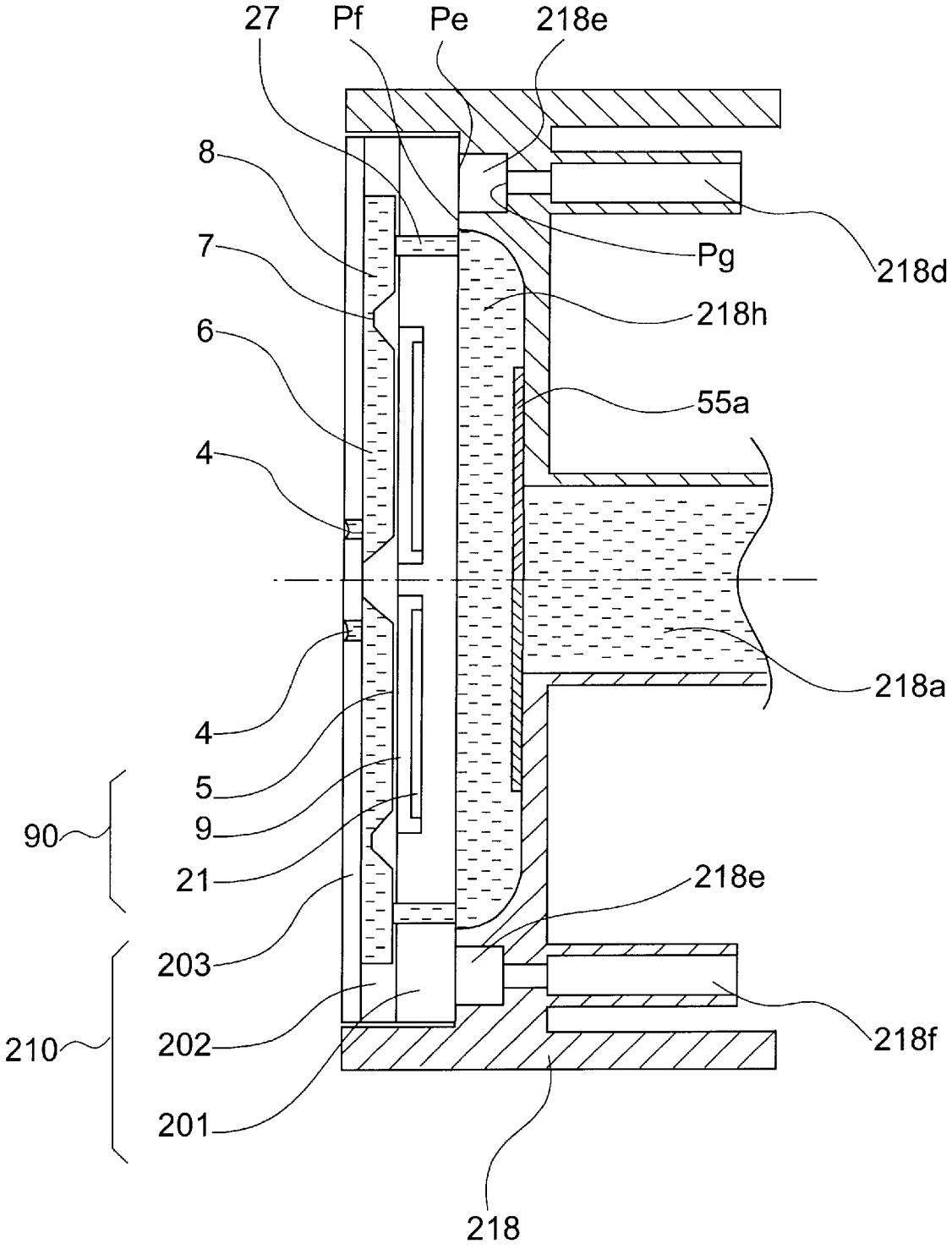
FIG. 11 is a cross-sectional view of the major components of the connection unit in the print head shown in FIG. 10.

FIG. 9 is a partially exploded perspective view of the structure of print head 211. FIG. 10 is a section view of the print head 211 shown in FIG. 9. FIG. 11 is a section view of the major parts of the connection unit in print head 211.

As seen in FIG. 9, print head 211 comprises chiefly ink tank 217, head case 218, and head component 210. A connection unit according to this preferred embodiment comprises head component 210 as a first component, and head case 218 as a second component.

Referring to FIG. 10, the ink tank 217 comprises an ink holding member 226, a filter 55*a* for trapping foreign matter in the ink, O-ring 224, and in the top an air inlet (not shown in the figures) for introducing to the ink tank 217 air equal to the volume of ink used. The ink holding member 226 is a porous material for holding ink thereinside.

As shown in FIG. 11, head component 210 comprises three layers 201, 202, and 203. Inside head component 210, electrostatic actuators 90 and a first ink passage comprising, nozzles 4, ejection chambers 6 linked to nozzles 4, orifices 7, and common ink cavity 8 are formed. Nozzles 4 are formed in rows on a surface of substrate 203 (nozzle plate). Ink lead-in opening 27 (first opening) is formed on surface Pe (first surface) of substrate 201.

It will thus be obvious that while head component 10 according to the first preferred embodiment of the present invention is typical of an edge-eject type inkjet head in which the nozzles are formed along an edge of the bonded substrates, head component 210 according to this second preferred embodiment of the invention is typical of a face-eject type inkjet head.

A recess for connecting head component 210 is provided in the bottom of head case 218. Ink supply opening 218*h* (second opening) for connection to ink lead-in opening 27 (first opening) of head component 210 is formed in the bottom surface Pf (second surface) of this recess. Bonding channel 218*e* is formed around ink supply opening 218*h* (second opening). An adhesive injection opening 218*d* (third opening) and vent hole 218*f* (fourth opening) are also open to the bonding channel 218*e*.

Bottom Pg (third surface) of bonding channel 218*e* is lower than bottom surface Pf (second surface) of the recess. As a result, when head component 210 is connected to the groove, a space to which adhesive is later filled is formed between surface Pe (first surface) of head component 210 and bottom Pg (third surface) of bonding channel 218*e*.

Ink can be supplied from ink tank 217 to head component 210 by pressing ink supply tube 218*a* of head case 218 into O-ring 224 of ink tank 217. Head case 218 is secured to ink tank 217 by screws 225, and terminals 219*b* of head FPC 219 are fixed with adhesive to ink tank 217.

Figure 12:
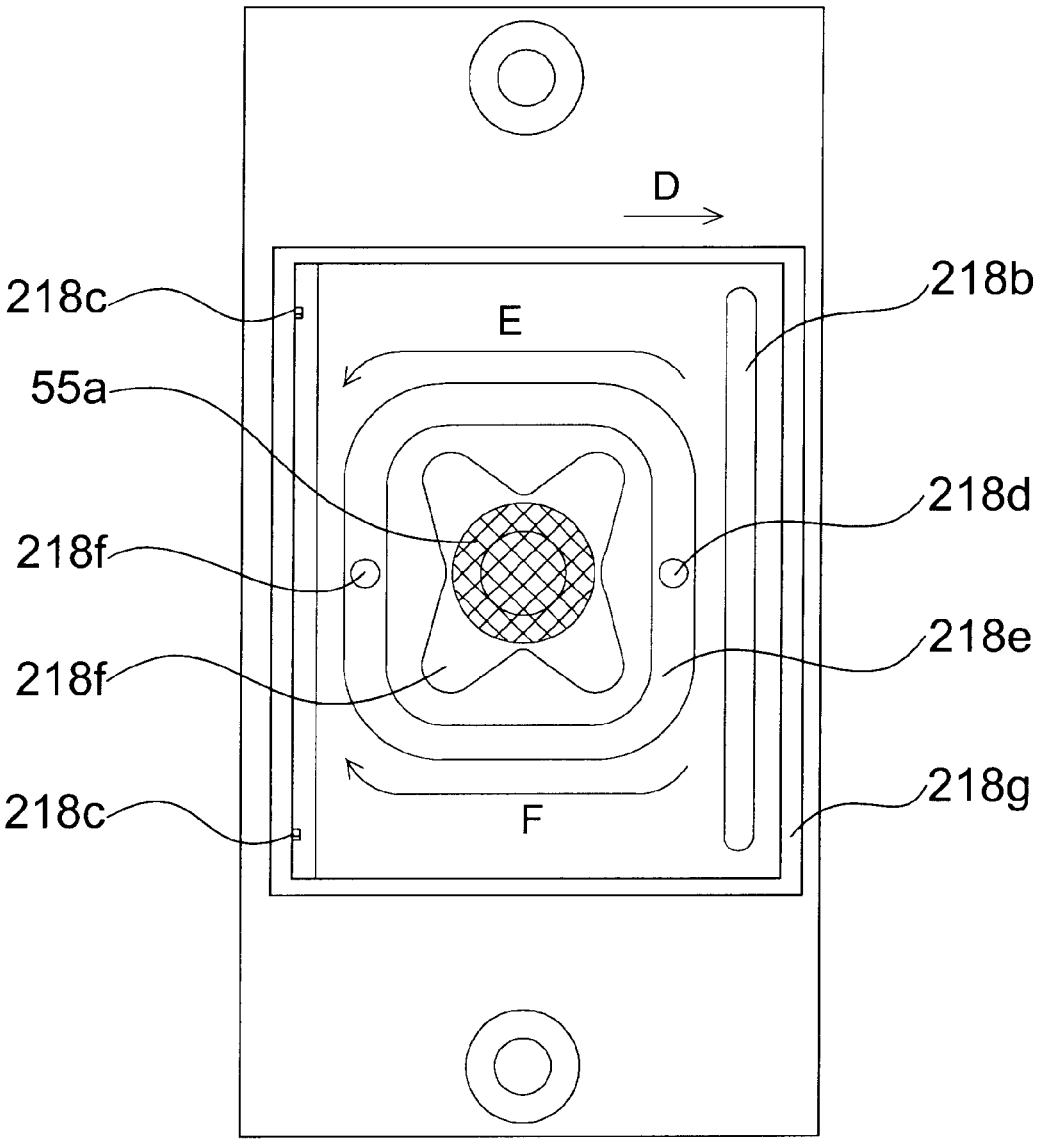
FIG. 12 is a plan view showing the front of the head case used in the print head shown in FIG. 10.
Figure 13:
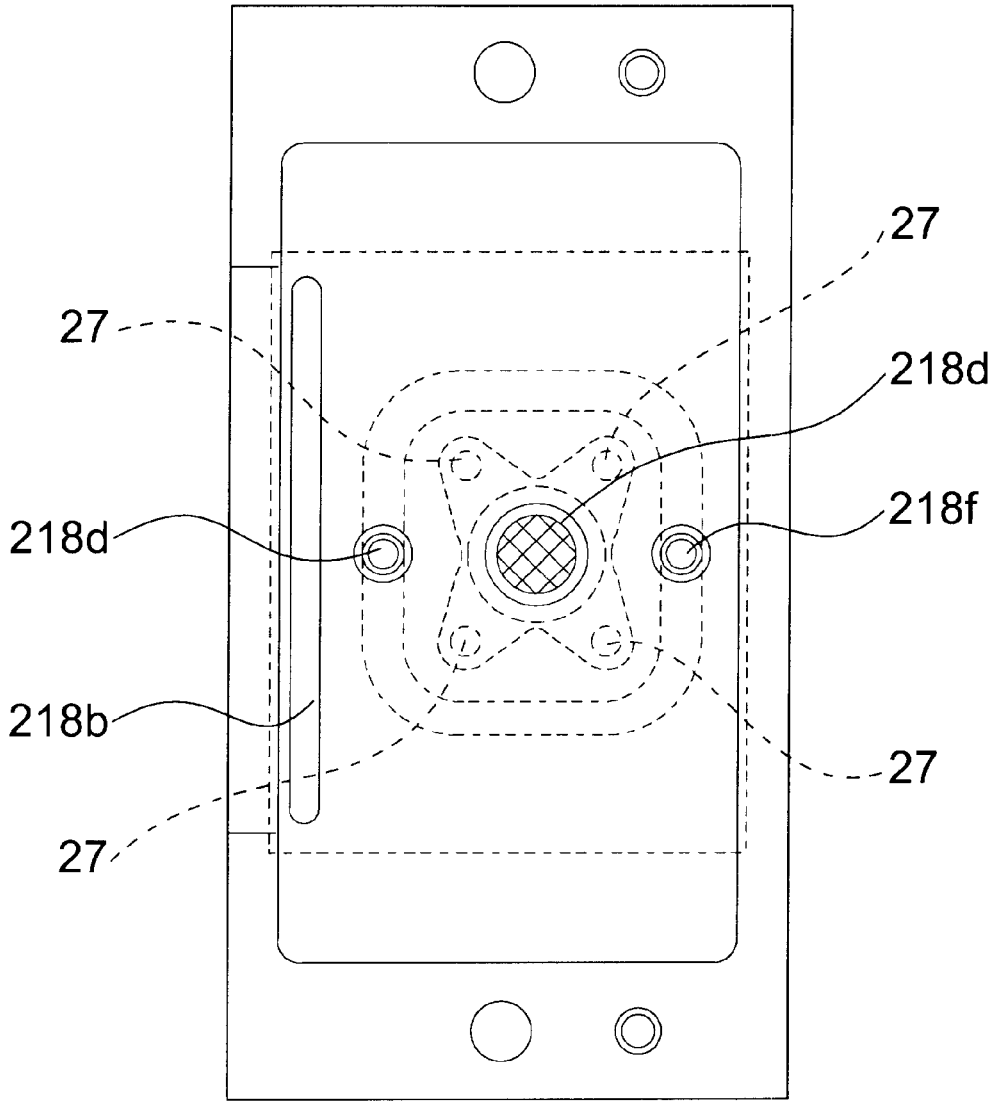
FIG. 13 is a plan view showing the back of the head case used in the print head shown in FIG. 10.

FIG. 12 is a plan view showing the front (side where the head component is bonded) of head case 218 when head component 210 is not attached thereto. FIG. 13 is a plan view showing the back (that is, the ink supply tube 218*a* side) of head component 210.

Filter 55*a* is heat fused to an end of ink supply tube 218*a* of head case 218. To bond head component 210 to head case 218, head FPC 219 (FIG. 9) connected to the head component 210 is passed through FPC conduit hole 218*b* in head case 218, and the head component 210 is then pushed into the bottom recess of head case 218.

Claws 218*c* disposed to head case 218 are deformed as head component 210 is pushed in, and push head component 210 to one side of the recess in the direction of arrow D, thereby positioning and holding the head component 210 until adhesive is injected.

As will be known from the figures, bonding channel 218*e* has an annular shape, and vent hole 218*f* (fourth opening) is disposed symmetrically to the position of adhesive injection opening 218*d* (third opening).

Adhesive is then injected from adhesive injection opening 218*d* (third opening) using a dispenser having an injection needle. The injected adhesive thus flows from adhesive injection opening 218*d* in both directions E and F, gradually filling the bonding channel 218*e,* meeting half way around the bonding channel 218*e,* and then rising from vent hole 218*f*. Because the path length is substantially identical in both directions E and F, the injected adhesive travels through the two paths and reaches vent hole 218*f* substantially simultaneously.

The worker can thus simply stop adhesive injection once the adhesive is confirmed to have emerged from vent hole 218*f,* and the bonding channel 218*e* can thus be reliably filled. Furthermore, even if there is an excessive overflow of adhesive from vent hole 218*f,* the adhesive injection pressure does not work in a direction tending to separate head component 210 from head case 218. As a result, it is not necessary to strictly control the amount of injected adhesive.

Adhesive can also be easily injected at low pressure, and the ink passage can be easily and reliably separated from the outside, because air inside the bonding channel 218*e* can escape from the vent hole 218*f*.

Other Embodiments

It will be obvious to one with ordinary skill in the related art that while the above preferred embodiments have been described with two holes connected to the bonding channel, three or more holes can be alternatively provided as required. Yet further, the bonding channel can be divided into a plurality of bonding channel segments, each having a plurality of holes connected thereto. Furthermore, these holes have been described as being disposed to the head case, but it will also be obvious that they can be alternatively disposed to the head component.

The above embodiments have also been described using an electrostatic actuator as the pressure generating means, but the invention shall obviously not be so limited. For example, a piezoelectric element or heating element could be used.

Benefits of the Invention

As will be known from the preceding description, a connection unit according to the present invention has the benefit of enabling the adhesive volume to be easily managed, and enabling adhesive to be injected with relatively low pressure. As a result, a high reliability connection unit that is free of ink ejection problems, and is free of ink leaks, can be provided.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

Key to reference number in the figures

1 first substrate
2 second substrate
3 third substrate
4 nozzle
5 diaphragm
6 ejection chamber
7 orifice
8 common ink cavity
9 vibration chamber
10 head component
15 recess
17 common electrode
21 individual electrode
22 lead
23 terminal
27 ink lead-in opening
30 nozzle case
31*a* opening
31 nozzle plate
32 ink-stop groove
33 pins
34 adhesive injection opening
36 protruding wall
37 claws
38 vent hole
39 adhesive puddle
40 head case
41 recess
42 recess
43 linkage holes
44 ink filling port
45 pins
46 plug
47 ink supply tube
48 bonding channel
49 groove
50 ink sack (reservoir)
51 opening
52 packing member
55 filter
56 ink supply tube
57 ink supply opening
60 ink case
61 opening
62 linkage holes
80 drive circuit
90 electrostatic actuator
102 terminal area
103 ink
104 ink drop
105 recording paper
210 head component
211*a* pins
211 print head
212*a* hooks
212*b* terminals
212*c* spring
212 carriage
213 carriage motor
214 guide shaft
215 flat cable
216 belt
217 ink tank (reservoir)
218 head case
218*a* ink supply tube
218*b* FPC conduit hole
218*c* claws
218*d* adhesive injection opening
218*e* bonding channel
218*f* vent hole
218*h* ink supply opening
218 head case
219*b* terminals

220 cap
224 O-ring
226 ink holding member
230 printing paper
231 paper feed roller
232 pressure roller
233 paper ejection roller

What is claimed is:

1. A connection unit for an ink jet head comprising:

a first component comprising a first passage, a first surface having a first opening in communication with said first passage, and a second surface surrounding said first surface;

a second component comprising a second passage, a third surface having a second opening in communication with said second passage, and a fourth surface surrounding said third surface, wherein said first component is arranged relative to said second component such that said first surface abuts said third surface;

a gap formed between said second and fourth surfaces;

a plurality of openings in communication with said gap, said openings being disposed in at least one of said first component and said second component; and an adhesive accommodated in said gap to secure said first component to said second component.

2. A connection unit for an ink jet head according to claim 1, further comprising a positioning member that positions said first component relative to said second component so as to align said first opening with said second opening.

3. A connection unit for an ink jet head according to claim 1, wherein said plurality of openings comprises a third opening for injecting said adhesive to said gap, and a fourth opening for bleeding air from inside said gap, and wherein said gap has an annular shape such that the annulus is divided into two segments linking the third opening and fourth opening, and the fourth opening is positioned relative to the third opening so that said two segments are substantially equal.

4. A connection unit for an ink jet head comprising:

a first component comprising a first passage and a first surface having a first opening in communication with said first passage;

a second component comprising a second passage, a second surface having a second opening in communication with said second passage, and a third surface surrounding said second surface, wherein said first component is arranged relative to said second component such that said first surface abuts said second surface;

a gap formed between said first and third surfaces;

a plurality of openings in communication with said gap, said openings being disposed in at least one of said first component and said second component; and an adhesive accommodated in said gap to secure said first component to said second component.

5. A connection unit for an ink jet head according to claim 4, further comprising a positioning member that positions said first component relative to said second component so as to align said first opening with said second opening.

6. A connection unit for an ink jet head according to claim 4, wherein said plurality of openings comprises a third opening for injecting said adhesive to said gap, and a fourth opening for bleeding air from inside said gap, and wherein said gap has an annular shape such that the annulus is divided into two segments linking the third opening and fourth opening, and the fourth opening is positioned relative to the third opening so that said two segments are substantially equal.

7. An ink jet cartridge comprising:

a first component comprising a first passage, a first surface having a first opening in communication with said first passage, and a second surface surrounding said first surface;

a second component comprising a second passage, a third surface having a second opening in communication with said second passage, and a fourth surface surrounding said third surface, wherein said first component is arranged relative to said second component such that said first surface abuts said third surface;

a gap formed between said second and fourth surfaces;

a plurality of openings in communication with said gap, said openings being disposed in at least one of said first component and said second component;

an adhesive accommodated in said gap to secure said first component to said second component; and a reservoir in communication with said second component.

8. An ink jet cartridge according to claim 7, further comprising an ink jet head having a nozzle in communication with said first passage.

9. An ink jet cartridge comprising:

a first component comprising a first passage and a first surface having a first opening in communication with said first passage;

a second component comprising a second passage, a second surface having a second opening in communication with said second passage, and a third surface surrounding said second surface, wherein said first component is arranged relative to said second component such that said first surface abuts said second surface;

a gap formed between said first and third surfaces;

a plurality of openings in communication with said gap, said openings being disposed in at least one of said first component and said second component;

an adhesive accommodated in said gap to secure said first component to said second component; and a reservoir in communication with said second component.

10. An ink jet cartridge according to claim 9, further comprising an ink jet head having a nozzle in communication with said first passage.

11. An ink jet printer comprising:

a first component comprising a first passage, a first surface having a first opening in communication with said first passage, and a second surface surrounding said first surface;

a second component comprising a second passage, a third surface having a second opening in communication with said second passage, and a fourth surface surrounding said third surface, wherein said first component is arranged relative to said second component such that said first surface abuts said third surface;

a gap formed between said second and fourth surfaces;

a plurality of openings in communication with said gap, said openings being disposed in at least one of said first component and said second component;

an adhesive accommodated in said gap to secure said first component to said second component;

a reservoir in communication with said second component; and an ink jet head having a nozzle in communication with said first passage.

12. An ink jet printer comprising:

a first component comprising a first passage and a first surface having a first opening in communication with said first passage;

a second component comprising a second passage, a second surface having a second opening in communication with said second passage, and a third surface surrounding said second surface, wherein said first component is arranged relative to said second component such that said first surface abuts said second surface;

a gap formed between said first and third surfaces;

a plurality of openings in communication with said gap, said openings being disposed in at least one of said first component and said second component;

an adhesive accommodated in said gap to secure said first component to said second component;

a reservoir in communication with said second component; and an ink jet head having a nozzle in communication with said first passage.

13. A method for forming a connection unit for an ink jet head comprising the steps of:

providing a first component comprising a first passage, a first surface having a first opening in communication with said first passage, and a second surface surrounding said first surface;

providing a second component comprising a second passage, a third surface having a second opening in communication with said second passage, and a fourth surface surrounding said third surface;

arranging said first component relative to said second component such that said first surface abuts said third surface;

forming a gap between said second and fourth surfaces;

disposing a plurality of openings in at least one of said first component and said second component to be in communication with said gap; and securing said first component to said second component by accommodating an adhesive in said gap.

14. A method for forming a connection unit for an ink jet head comprising the steps of:

providing a first component comprising a first passage and a first surface having a first opening in communication with said first passage;

providing a second component comprising a second passage, a second surface having a second opening in communication with said second passage, and a third surface surrounding said second surface;

arranging said first component relative to said second component such that said first surface abuts said second surface;

forming a gap between said first and third surfaces;

disposing a plurality of openings in at least one of said first component and said second component to be in communication with said gap; and securing said first component to said second component by accommodating an adhesive in said gap.

15. A method for forming an ink jet cartridge comprising the steps of:

providing a first component comprising a first passage, a first surface having a first opening in communication with said first passage, and a second surface surrounding said first surface;

providing a second component comprising a second passage, a third surface having a second opening in communication with said second passage, and a fourth surface surrounding said third surface;

arranging said first component relative to said second component such that said first surface abuts said third surface;

forming a gap between said second and fourth surfaces;

disposing a plurality of openings in at least one of said first component and said second component to be in communication with said gap;

securing said first component to said second component by accommodating an adhesive in said gap; and providing a reservoir in communication with said second component.

16. A method for forming an ink jet cartridge comprising the steps of:

providing a first component comprising a first passage and a first surface having a first opening in communication with said first passage;

providing a second component comprising a second passage, a second surface having a second opening in communication with said second passage, and a third surface surrounding said second surface;

arranging said first component relative to said second component such that said first surface abuts said second surface;

forming a gap between said first and third surfaces;

disposing a plurality of openings in at least one of said first component and said second component to be in communication with said gap;

securing said first component to said second component by accommodating an adhesive in said gap; and providing a reservoir in communication with said second component.

* * * * *